US006050773A

United States Patent [19]

Bushnell

[11] Patent Number: 6,050,773

[45] Date of Patent: Apr. 18, 2000

[54] FLOW STABILIZER FOR TRANSVERSE FAN

[75] Inventor: Peter R. Bushnell, Cazenovia, N.Y.

[73] Assignee: Carrier Corporation, Syracuse, N.Y.

[21] Appl. No.: 08/880,763

[22] Filed: Jun. 23, 1997

[51] Int. Cl.[7] ..... F04D 5/00

[52] U.S. Cl. ..... 415/53.1; 415/119; 415/178

[58] Field of Search ..... 165/122, 135; 415/53.1, 53.2, 53.3, 119, 175, 176, 178, 211.1

[56] References Cited

U.S. PATENT DOCUMENTS

| | | | |
|---|---|---|---|
| 3,366,169 | 1/1968 | Laing | 165/122 |
| 3,846,617 | 11/1974 | Glucksman | 165/122 |
| 5,094,586 | 3/1992 | Takada et al. | 415/53.3 |
| 5,564,495 | 10/1996 | Yoshihashi et al. | 165/122 |

FOREIGN PATENT DOCUMENTS

| | | | |
|---|---|---|---|
| 0 277 044 | 8/1988 | European Pat. Off. . | |
| 98 63 0024 | 9/1998 | European Pat. Off. . | |
| 1 372 102 | 12/1964 | France . | |
| 19 51 115 | 4/1971 | Germany . | |
| 40 23 263 | 2/1991 | Germany . | |
| 61-128038 | 6/1986 | Japan | 165/122 |

*Primary Examiner*—Christopher Verdier

[57] ABSTRACT

A flow stabilizer is provided for reducing low frequency flow oscillations within and the resultant noise from the impeller of a transverse fan. Such oscillations and noise can arise in installations where the fan is located downstream of the heat exchanger in an air conditioning unit. The stabilizer is a vane located between the downstream face of the heat exchanger and the suction side of the impeller. The vane is positioned and oriented so as to reduce localized counter swirling flow that otherwise would cause oscillating blade stall within the impeller and associated noise.

6 Claims, 7 Drawing Sheets

FLOW STABILIZER FOR TRANSVERSE FAN

BACKGROUND OF THE INVENTION

Low frequency flow oscillations may arise in air conditioning systems using a transverse fan situated downstream of a plate-fin heat exchanger. These oscillations are associated with swirling flow, counter to the fan rotation, between the downstream face of the heat exchanger and fan inlet. Such conditions cause excessive flow incidence angles over a local sector of the impeller inlet, producing retarded, or stalled, flow within that sector.

The localized nature of the stalled flow leads to its being unstable and oscillatory, with frequency, $f_s$, in the range of 30 to 80 percent of the fan rotational frequency, n. Blade interaction with the unsteady, oscillating stall results in excess noise with a frequency corresponding to the product of the stall oscillation frequency, $f_s$, the number of blades in the impeller, Z, and the fan rotational frequency, n. The product of Z.n is the blade passing frequency, BPF, and the excess noise is, therefore, sub-BPF noise with frequency in the range of 30 to 80 percent of BPF.

SUMMARY OF THE INVENTION

The present invention relates generally to transverse or cross-flow fans. More particularly, the invention relates to a transverse fan having a stabilizer vane that prevents the creation of an oscillating air flow stall and resultant sub-blade pass frequency noise.

The present invention employs a flow stabilizing vane that prevents or reduces oscillating blade stall and the resultant noise in a transverse fan and heat exchanger assembly that is subject to such a stall phenomenon. The vane is approximately the same width as the downstream face of the heat exchanger and projects from that face. The vane extends towards the fan impeller with a small gap between its distal end and the impeller. The vane may be straight in lateral cross section but, in a preferred embodiment, the cross section is other than straight in order to achieve structural rigidity, and thus prevent flutter, without excessive vane thickness. The description of the preferred embodiments below discloses preferred sizing, placement and orientation of the vane.

It is an object of this invention to prevent oscillating blade stall.

It is another object of this invention to reduce or eliminate low frequency flow oscillations in transverse fan coil arrangements. These objects, and others as will become apparent hereinafter, are accomplished by the present invention.

Basically, a single vane is located on the downstream side of a heat exchanger oriented so as to impart a rotational flow in the direction of fan rotation, in the region just upstream of the narrowest gap between the fan and the heat exchanger, and to thereby reduce localized counter swirling flow that would otherwise tend to cause oscillating blade stall and the resultant noise.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
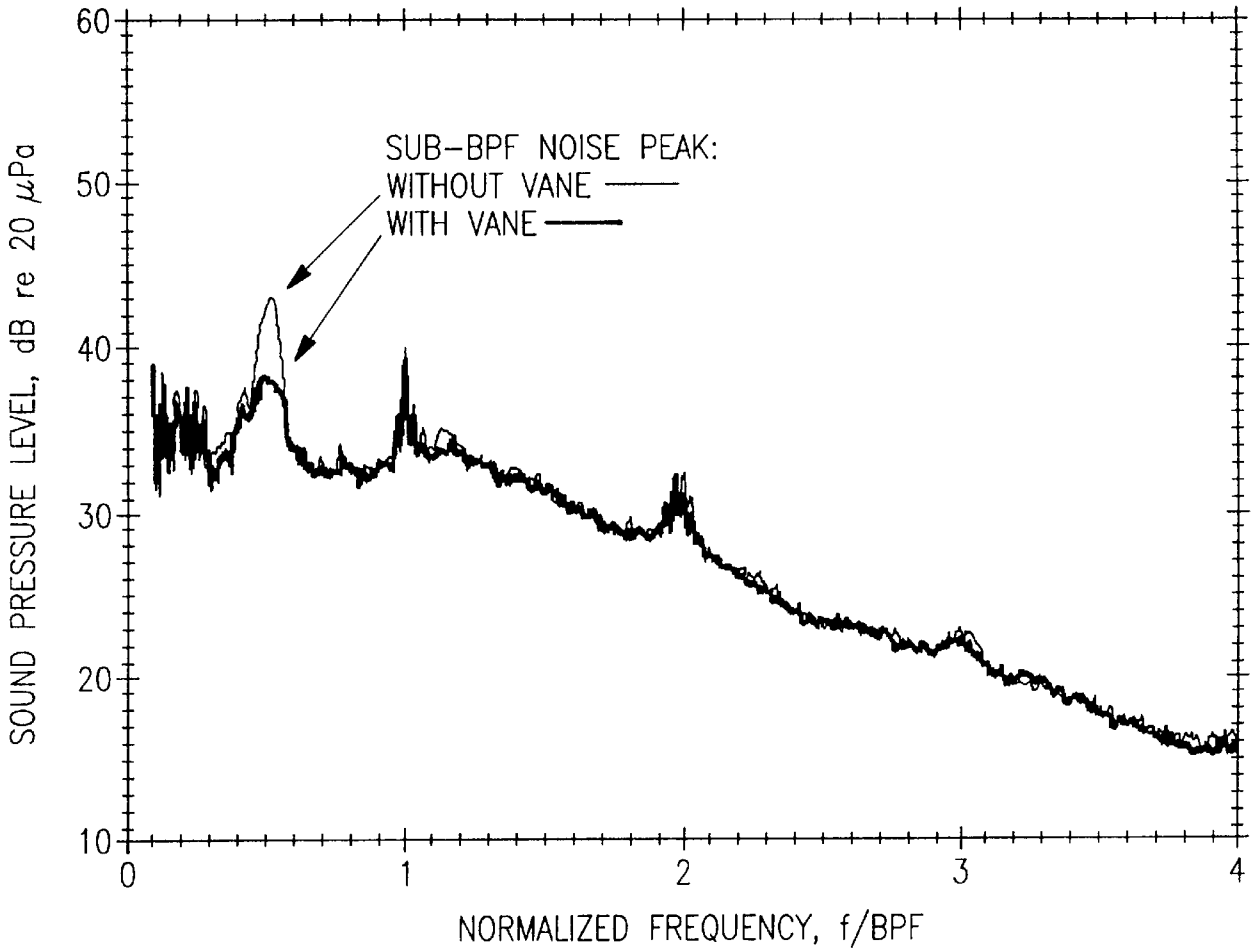
FIG. 1 is a plot of sound pressure level in decibels vs. normalized frequency, f/BPF, where f is the sound frequency in cycles per second and BPF is the blade passing frequency in cycles per second for a PRIOR ART unit and one employing the vane of the present invention.

FIG. 1 shows the measured sound pressure level vs. normalized frequency in the presence and absence of the vane of the present invention. While the data generally track each other, the vane of the present invention substantially lowers the broad sub-BPF peak as compared to a corresponding unit lacking the vane of the present invention.

Figure 2:
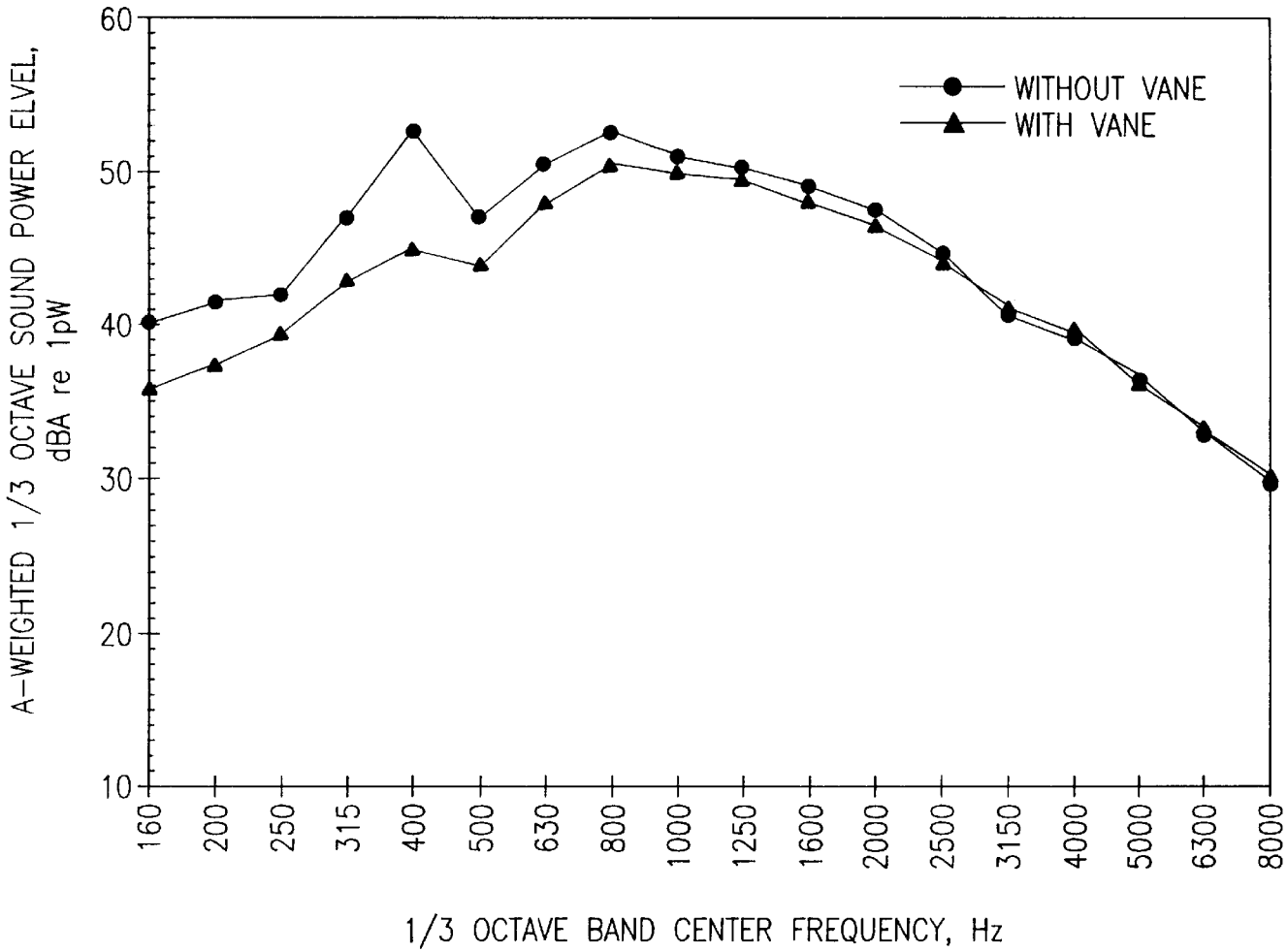
FIG. 2 shows the ⅓ octave, A-weighted, sound power spectrum for a PRIOR ART unit, and for one employing a vane.

FIG. 2 shows the A-weighted ⅓ octave sound power spectra corresponding to FIG. 1. A-weighting provides a correction to represent the human hearing range. The presence of the vane of the present invention significantly reduces the low frequency noise.

Figure 3:
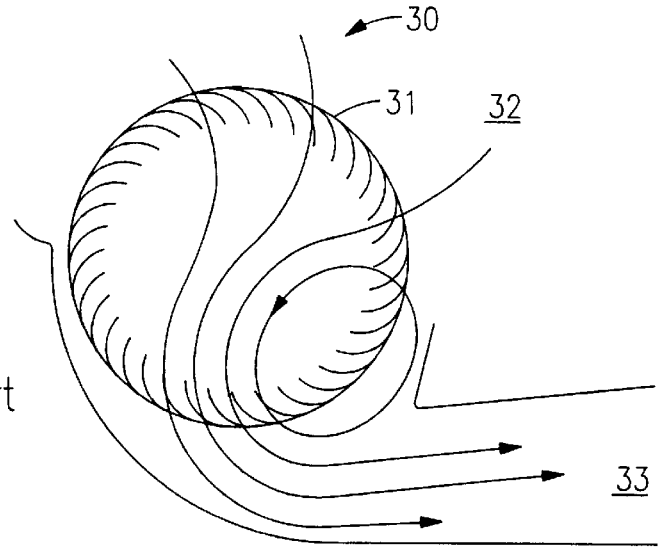
FIG.3 Prior Art
FIG. 3 is a schematic diagram of a PRIOR ART transverse fan operating with an unobstructed inlet.
Figure 4:
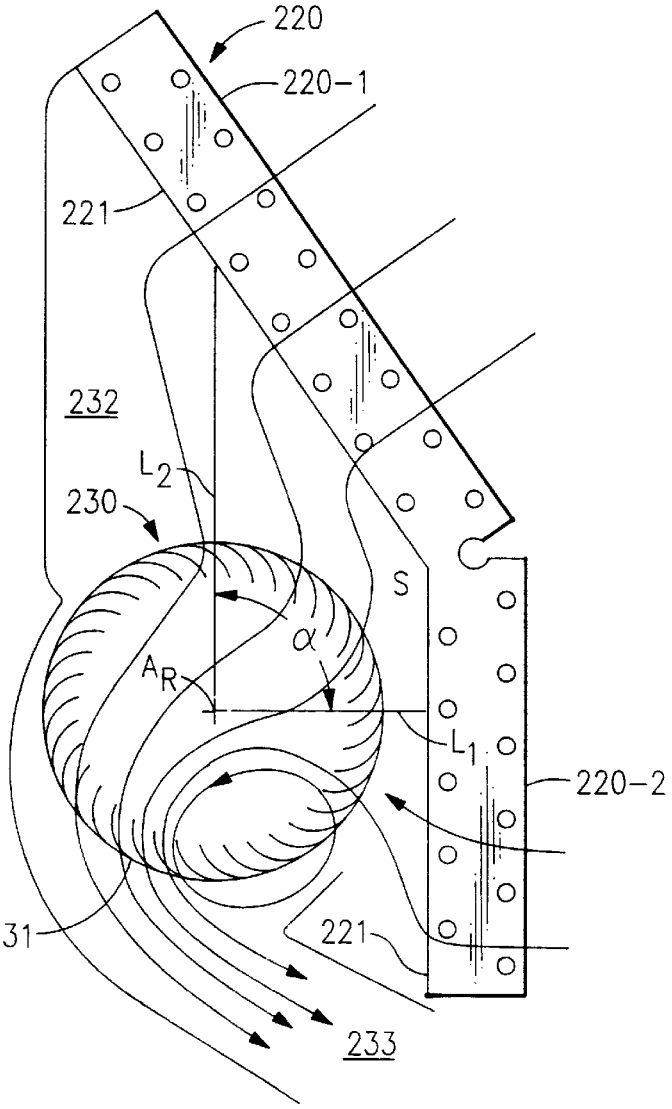
FIG.4 Prior Art
FIG. 4 is a schematic diagram of a PRIOR ART transverse fan operating in adverse aerodynamic conditions caused by its positioning with respect to its associated heat exchanger.
Figure 5:
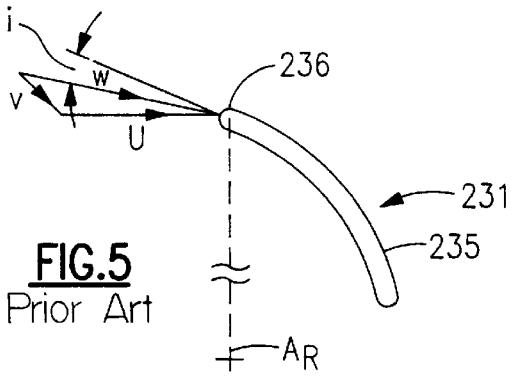
FIG.5 Prior Art
FIG. 5 is a schematic diagram of the air flow vectors entering the blade of a transverse fan operating in the same conditions as depicted in FIG. 4.

In FIG. 3, PRIOR ART transverse or cross flow fan 30 is operating in a clean inflow environment. The streamlines, show a smooth transit from suction inlet 32 through impeller 31 to discharge outlet 33. The streamline in a closed loop represents a well known vortex region within the fan. PRIOR ART fan 230, depicted in FIG. 4, is operating in an aerodynamic environment that is conducive to the production of the sub-BPF noise. Fan 230 differs from fan 30 in the addition of heat exchanger 220. Heat exchanger 220 is illustrated as being made up of two sections, 220-1 and 220-2, but may be made as a single section or more than two sections. Impeller 231 is located very close to a portion of downstream face 221 of heat exchanger 220. Further, the air that impeller 231 draws from the uppermost reaches of the downstream face 221 tends to turn through a large angle to enter and pass through the impeller, as shown by the streamlines, into discharge outlet 233. In region S of suction inlet 232, the periphery or tips of the blades of impellers 231 are advancing into the incoming air flowing against the direction of rotation starting at the point of closest proximity between impeller 231 and face 221 as determined by line $L_1$, which is a line extending from axis $A_R$ of fan 231 perpendicularly to face 221 of heat exchanger 220. Region S extends in the direction of rotation from $L_1$ to $L_2$ with $L_2$ being 130% of outer diameter $D_o$ of the impeller from axis $A_R$. FIG. 5 shows a blade, 235, of impeller 231 having a tip 236 and rotating about an axis, $A_R$, at a rotational speed of n revolutions per second to produce the illustrated vector relationship among blade tip peripheral velocity U, absolute air velocity V and resultant relative air velocity W in region S. If the direction of velocity V is sufficiently close to the direction of velocity U, resultant air velocity W can lead to an excessive flow angle of incidence, i, that results in stall or separation of the air flowing over the blade 235.

Figure 6:
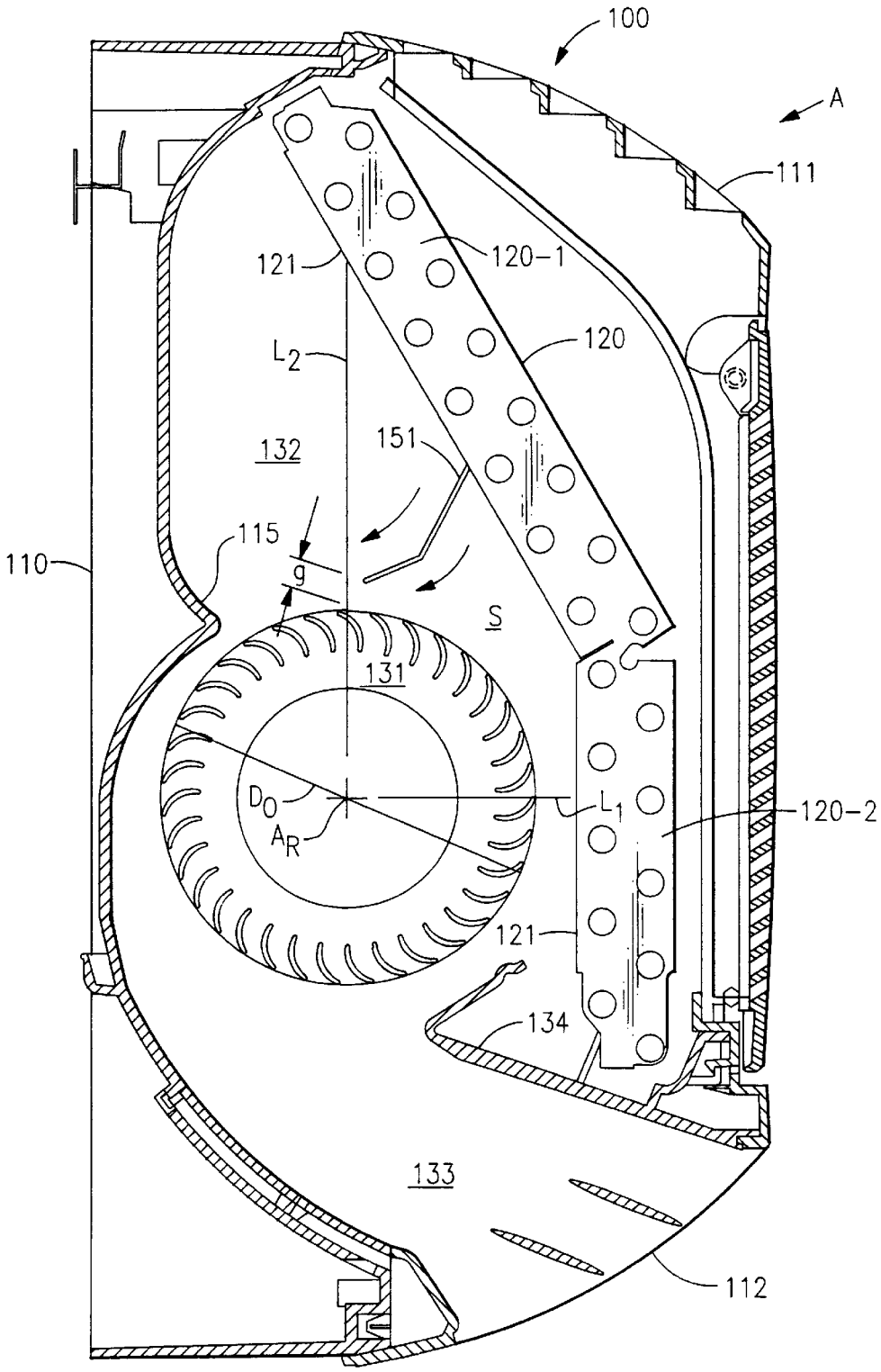
FIG. 6 is a schematic diagram of a transverse fan operating in the same conditions as depicted in FIG. 4 but with the vane of the present invention installed.

Referring now to FIG. 6, the numeral 100 generally designates a fan coil unit having a casing 110 having inlet grill 111 and outlet louvers 112. Heat exchanger 120 is located within casing 110 in facing relationship with inlet grill 111 and includes two sections, 120-1 and 120-2, having a downstream face 121. Impeller 131 is located in casing 110 so as to rotate about its axis, $A_R$, and coacts with vortex wall 134 and rear wall 115 to divide the interior of casing 110 into suction inlet 132 and discharge outlet 133 with fluid communication being through impeller 131. Vane 151 of the present invention extends outward from downstream face 121 of heat exchanger 120 towards impeller 131. The vane 151 is located in the region of the suction side of impeller where the blades of impeller 131 are advancing into the incoming air flow (region S in FIG. 4). Vane 151 does not touch impeller 131 but rather there is a gap, g, between vane 151 and impeller 131. In a preferred embodiment, gap g is between 0.08 and 0.15 times outer diameter $D_o$ of impeller 131. As illustrated, vane 151, in lateral cross section, is curved or bent. The cross sectional shape is both for structural rigidity and for air flow considerations, as a straight cross section may require additional material to provide sufficient rigidity to prevent flutter in the incoming air flow. If the vane 151 is curved, or a combination of straight lines, the vane should be positioned to direct the incoming air flow in the same direction as the direction of rotation of impeller 131.

In operation of the fan coil unit 100, the rotation of impeller 131 draws air into suction inlet 132 via grill 111 and heat exchanger 120. Since air exits from heat exchanger 120 over the entire downstream face 121, the air must turn varying amounts as it passes from different portions of downstream face 121 and enters impeller 131. Air passes from impeller 131 into discharge outlet 133 and via louvers 112 into the space to be conditioned. It will be noted that impeller 131 is separated from portions of heat exchanger 120 by varying distances. As described with respect to FIG. 4, starting with the point of closest proximity between impeller 131 and face 121 which is along line $L_1$, a region S is defined in the direction of rotation which is conducive to oscillating stall and the production of noise. The presence of vane 151, in accordance with the teachings of the present invention, provides a reduced opportunity for oscillating stall to occur. This is because the vane 151 reduces the incidence angle of the flow entering the blades in region S by imparting a localized pre-rotation on the flow i.e. rotation in the same direction as the fan rotation.

Figure 8:
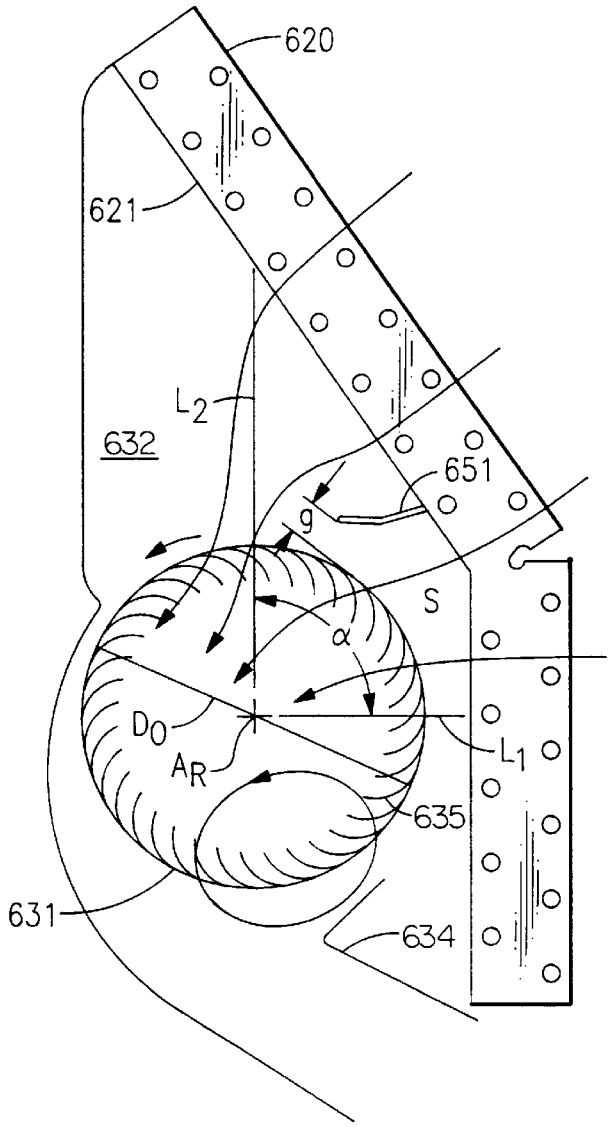
FIGS. 7–10 are schematic diagrams of a transverse fan in four different installations and illustrate some dimensional relationships useful in describing the present invention.
Figure 10:
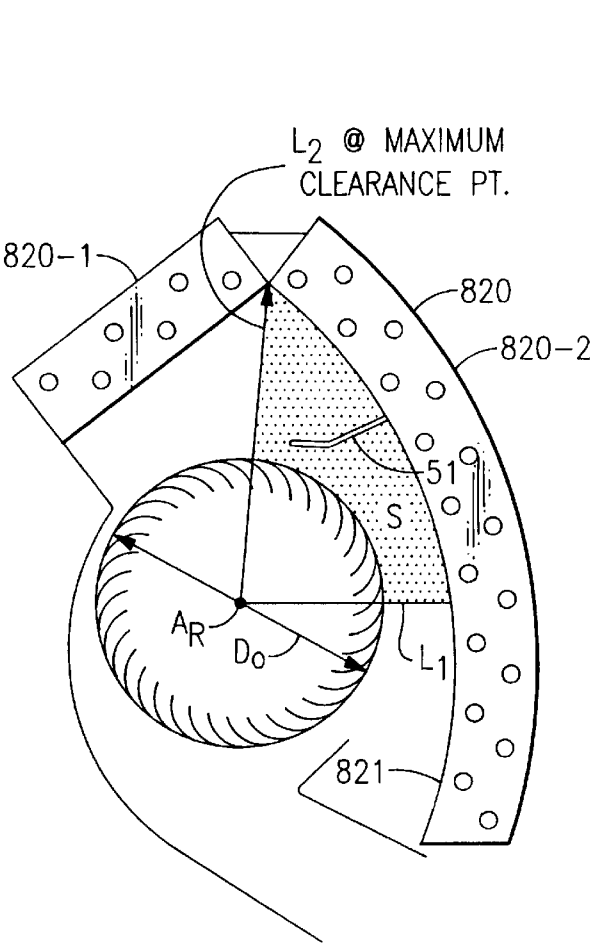
Figure 9:
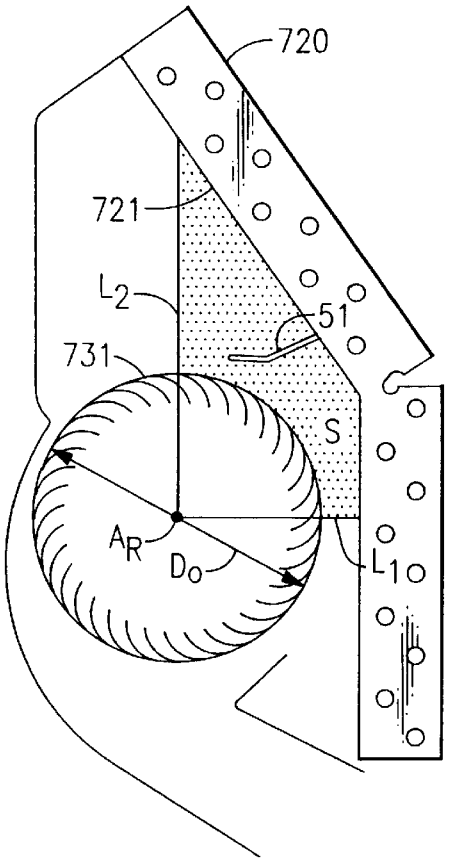
Figure 7:
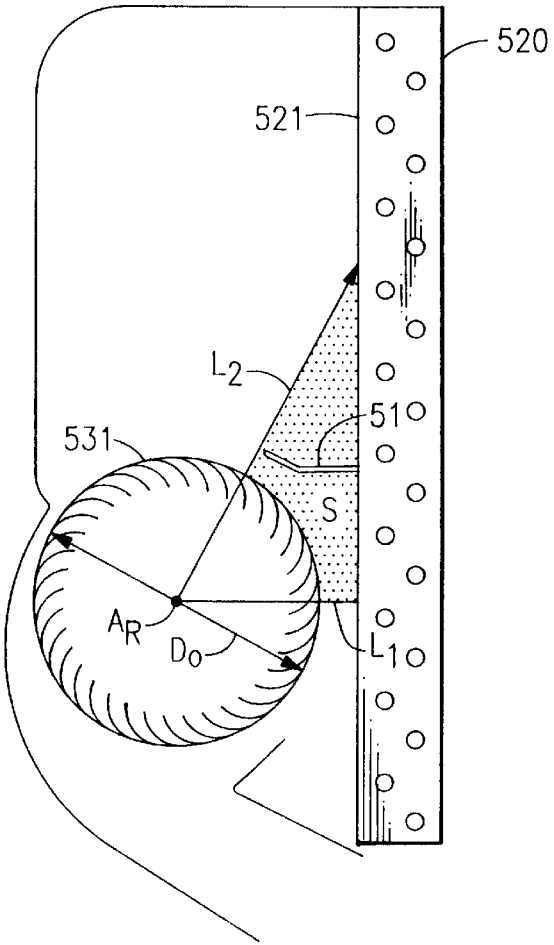

The size and positioning of the vane 151 is important to achieving the objective of reducing noise due to oscillating stall. FIGS. 7–10 serve to illustrate the principles involved. FIGS. 7–10 show four different transverse fan and heat exchanger assembly arrangements. In FIG. 7, heat exchanger 520 has planar downstream face 521. Impeller 531 is located in a spaced relationship to face 521. In FIGS. 8 and 9, heat exchangers 620 and 720 are "bent", as is heat exchanger 120 of FIG. 6, with the relative location of the "bend" and the positioning of impellers 631 and 731, respectively, are different in the two Figures. Referring specifically to FIG. 8, impeller 631 has blades 635. In operation, impeller 631 draws air from suction inlet 632. Vane 651 coacts with the flowing air to change the air flow pattern, as compared to FIG. 4, as shown by the arrows indicating flow. The streamline in the closed loop near vortex wall 634 is the vortex region. In FIG. 10, heat exchanger 820 is also bent and made up of two sections 820-1 and 820-2. However, section 820-2 is curved. "Bent" heat exchangers are commonly found in applications where the required facial area of the heat exchanger cannot be obtained with a straight faced heat exchanger within the dimensions of the enclosure in which the heat exchanger is installed. The indoor units of duct-free split air conditioning systems, for example, commonly have "bent" heat exchangers. (One skilled in the art understands that a duct-free split air conditioning system is a vapor compression air conditioning system that does not have a central inside heat exchanger with ducting to deliver conditioned air to rooms or spaces to be conditioned but rather has one or more inside heat exchangers each located in an individual room or space to be conditioned.) The principles governing the sizing and positioning of the vane 551, however, are the same regardless of the shape of the heat exchanger and the positioning of the fan impeller with respect to the heat exchanger.

Figure 11:
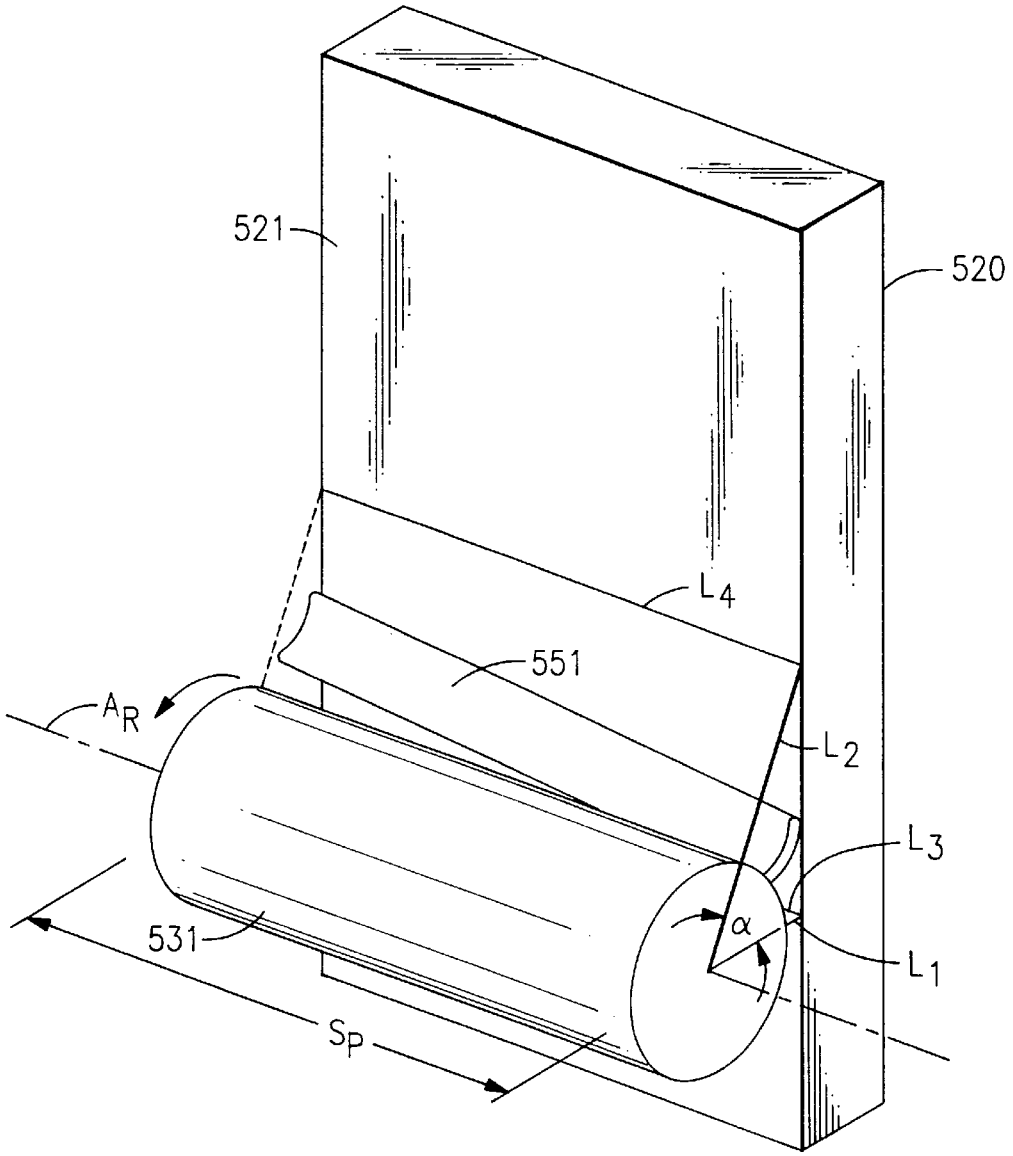
FIG. 11 is a view of a transverse fan and the vane of the present invention.

In each of FIGS. 6 through 11, line $L_1$ passes through impeller axis of rotation $A_R$ and is perpendicular to downstream face 121, 521, 621, or 721 and to the nearest point on 821. Line $L_2$ passes through impeller axis of rotation $A_R$ and a point on downstream face 121, 520, 620, 721 or 821 that is at the point of maximum clearance or a distance of 1.3 times impeller outer diameter $D_o$ from axis of rotation $A_R$. Angle $\alpha$ (FIGS. 4, 8 and 11) between lines $L_1$ and $L_2$ defines region S in which the oscillating stall tends to occur. Turning to FIG. 11, line $L_1$ and axis of rotation $A_R$ define a plane that intersects face 521 in line $L_3$. Line $L_2$ and axis of rotation $A_R$ define a plane that intersects faces 20 in line $L_4$. Not shown in the Figures but easily visualized is that impeller 531 has a swept surface that may be defined as the surface of a cylinder generated by rotating a line that is parallel to axis of rotation $A_R$ and that also passes through a point that is radially outermost on impellers 531.

For best effectiveness in reducing oscillating stall noise, the vane 551 should be positioned and sized so that it is contained within the envelope defined by the downstream face 521, the plane defined by axis of rotation $A_R$ and line $L_1$, the plane defined by axis of rotation $A_R$ and line $L_2$ and the impeller swept surface. There should be a gap 0.08 to 0.15 times impeller outer diameter between impeller 531 and vane 551 discussed above.

One skilled in the art may appreciate that a vane constructed and installed according to the teaching of the present invention could be a source of blade passing frequency noise. This may be prevented or minimized by positioning the vane so that different points on the same impeller blade do not pass the vane at the same time. Vane 551 in FIG. 11 is positioned in such a way. FIG. 11 also shows vane 551 positioned with respect to impeller 531 so as to minimize blade passing frequency noise.

The vane of the present invention has been tested in duct-free split fan coil units that exhibit sub-BPF noise problems, and shown to reduce the sub-BPF noise by five to eight decibels. FIGS. 1 and 2 illustrate the results from one such case.

Although preferred embodiments of the present invention have been illustrated and described, other changes will occur to those skilled in the art. It is therefore intended that the scope of the present invention is to be limited only by the scope of the appended claims.

What is claimed is:

1. An improved transverse fan and heat exchanger assembly defining a flow path serially including said heat exchanger and said fan, said fan having an impeller with impeller blades and a suction side defined in said flow path intermediate said heat exchanger and said fan whereby as said impeller is rotated said impeller blades advance into air flowing into said impeller via said flow path as said impeller blades advance into said suction side, said heat exchanger having a downstream face, in which the improvement comprises:

a flow stabilizer vane extending from said downstream face towards said impeller and in the same direction in which said impeller is rotated and toward said impeller in said region of said suction side whereby a rotational flow is imparted to air flowing into said impeller in the same direction as that of impeller rotation.

2. The improved transverse fan and heat exchanger assembly of claim 1 in which said impeller has an outer diameter and said vane extends to within a clearance of 8 to 15 percent of said outer diameter from said impeller.

3. The improved transverse fan and heat exchanger assembly of claim 1 in which said impeller has an outer diameter and an axis of rotation and said assembly has a first location on said downstream face, said first location being the intersection of said face and a first plane, said first plane being defined by said axis of rotation and a line that passes through said axis of rotation and is perpendicular to said face, and a second location on said downstream face, said second location being the intersection of said face and a second plane, said second plane being defined by said axis of rotation and a line that passes through said axis of rotation and that also passes through a point on said face that is at a distance of approximately 130 percent of said outer diameter from said axis of rotation so as to provide a clearance of approximately 80% of said outer diameter between said impeller and said point on said face that is at a distance of approximately 130% of said outer diameter, and said vane extends from said downstream face from along a third location on said face that is between said first location and said second location.

4. The improved transverse fan and heat exchanger assembly of claim 3 in which said impeller has a swept surface, said swept surface being the surface of a cylinder generated by rotating a line that is parallel to said axis of rotation and that also passes through a point radially outermost on said impeller, and said vane is contained within an envelope defined by said downstream face, said first plane, said second plane and said swept surface.

5. The improved transverse fan and heat exchanger assembly of claim 1 in which said vane is configured so that different points along the span of a given impeller blade pass said vane at different times.

6. The improved transverse fan and heat exchanger assembly of claim 1 in which said flow stabilizer vane is approximately the same width as said downstream face.

* * * * *